US007339450B2

(12) United States Patent
Lueg-Althoff et al.

(10) Patent No.: US 7,339,450 B2
(45) Date of Patent: Mar. 4, 2008

(54) INDUCTIVE MINIATURE COMPONENT, ESPECIALLY ANTENNA

(75) Inventors: Joachim Lueg-Althoff, Lüdenscheid (DE); Eugeniusz Swoboda, Iserlohn (DE); Viktor Thiel, Lüdenscheid (DE)

(73) Assignee: Neosid Pemetzrieder GmbH & Co (DE)

( * ) Notice: Subject to any disclaimer, the term of this patent is extended or adjusted under 35 U.S.C. 154(b) by 93 days.

(21) Appl. No.: 10/578,793

(22) PCT Filed: Oct. 2, 2004

(86) PCT No.: PCT/DE2004/002205

§ 371 (c)(1),
(2), (4) Date: May 3, 2006

(87) PCT Pub. No.: WO2005/045992

PCT Pub. Date: May 19, 2005

(65) Prior Publication Data

US 2007/0091009 A1 Apr. 26, 2007

(30) Foreign Application Priority Data

Nov. 3, 2003 (DE) ..... 103 51 119

(51) Int. Cl.
*H01F 5/00* (2006.01)

(52) U.S. Cl. ..... 336/200; 343/787

(58) Field of Classification Search ..... 336/65, 336/83, 198, 200, 220–223, 232; 343/787–788; 29/599–600, 602.1, 605–606
See application file for complete search history.

(56) References Cited

U.S. PATENT DOCUMENTS 4,825,166 A * 4/1989 MacGugan ..... 324/346
4,907,346 A * 3/1990 Watanabe ..... 33/361

(Continued)

FOREIGN PATENT DOCUMENTS

DE 198 12 836 9/1999

(Continued)

*Primary Examiner*—Tuyen T. Nguyen
(74) *Attorney, Agent, or Firm*—Robert W. Becker; Robert W. Becker & Assoc

(57) ABSTRACT

Disclosed is an inductive miniature structural element, particularly an antenna. Said structural element comprises a winding member (1) which is embodied as a flat component and on which three coil windings (2X, 2Y, 2Z) are mounted in such a way that the axes of said coil windings point in the three three-dimensional directions (X, Y, Z). The winding member (1) is made at least in part of ferrite material while the top face and the bottom face thereof are provided with guiding elements (1.5, 1.6, 1.7, 1.8) for directing the third coil winding. The winding member (1) is placed on a coil plate (3) made of electrically non-conducting, non-ferromagnetic material and is connected thereto. The coil plate (3) is provided with recesses into which the guiding elements that are located on the bottom face of the winding member (1) engage. The ends of the first and second coil winding (2X, 2Y) are wound around the guiding elements located on the bottom face of the winding member, respectively, while the ends of the third coil winding (2Z) are wound around corners or projections of the coil plate (3), respectively.

14 Claims, 10 Drawing Sheets

U.S. PATENT DOCUMENTS

| | | | | |
|---|---|---|---|---|
| 6,181,130 | B1 * | 1/2001 | Hoshi et al. | 324/253 |
| 6,734,668 | B2 * | 5/2004 | Hils et al. | 324/232 |
| 6,924,767 | B2 * | 8/2005 | Kitahara et al. | 343/702 |
| 7,042,411 | B2 * | 5/2006 | Yagi et al. | 343/788 |

FOREIGN PATENT DOCUMENTS

| | | |
|---|---|---|
| GB | 2 326 769 | 12/1998 |
| JP | 2003-092509 | 3/2003 |

* cited by examiner 1.5
2Y
1.6
2X
1.3
1
1.8
1.7
2.1Y
1.4
winding, crossing and tinning
the X-winding and the Y-winding 1.6
1.2
1.5
1.7
1
1.1
8
1.8
application of glue 3.2
3
3.3
1
3.1
2.1Y
1.4
3.4
joining the
parts 1
3
winding of the Z-winding
and tinning the X-winding and
the Y-winding 2Y
1
2X
3
2Z
measuring and
packing blister
pack

INDUCTIVE MINIATURE COMPONENT, ESPECIALLY ANTENNA

This specification for the instant application should be granted the priority date of Nov. 3, 2003, the filing date of the corresponding German patent application 103 51 119.9 as well as the priority date of Oct. 2, 2004, the filing date of the corresponding International patent application PCT/DE2004/002205.

BACKGROUND OF THE INVENTION

The invention relates to an inductive miniature component, especially an antenna, with a winding element that is configured as a flat, rectangular or many-sided part, on which three windings are disposed in such a way that the axes of those windings extend in the three spatial directions (X, Y, Z) that are located at right angles relative to each other. A first and a second winding, occupying the length and width of the winding element, are wound around the winding element in two directions that lie perpendicular to each other in the central plane of the winding element. A third winding is wound around the winding element along its narrow side and following its periphery, whereby the winding element is at least partly composed of ferrite material and has, located on its bottom side, guide elements for guiding one side of the third winding.

Components of the aforementioned kind are generally known. They can for example be used as antennas in a keyless access system for motor vehicles or in devices that use radio waves for the remote control.

The manufacturing of the components of that kind that are known hitherto causes problems since some steps of the manufacturing process, especially the application of the third winding, have to be accomplished by hand.

It is an object of the invention to configure an inductive miniature component, especially an antenna, having the features described in the introduction in such a way that a fully automatic manufacturing, which requires little effort, is possible, nevertheless ensuring a secure seating of the third winding.

SUMMARY OF THE INVENTION

The object of the invention is realized by means of the following features:

a) The winding element has, on its top side, guide elements that guide the other side of the third winding;

b) the guide elements on the top side of the winding element are composed of ferrite material and are formed in one piece with the winding element, which is made of ferrite material;

c) the winding element is placed onto and connected with a coil plate made of electrically non-conducting, non-ferromagnetic material;

d) the coil plate has recesses, which extend over its thickness and, with their inner contour and arrangement, correspond to the outer contour and arrangement of the guide elements that are located on the bottom side of the winding element; the winding element is placed onto the coil plate in such a way that the guide elements on its bottom side engage into the recesses in the coil plate;

e) the ends of the first and the second winding are wound around the guide elements on the bottom side of the winding element;

f) the ends of the third winding are wound around the corners or projections of the coil plate.

Advantageous further developments of the component according to the invention are described below and in the dependent claims. Methods for the fully automatic manufacturing of the component according to the invention are described in the claims.

It is one fundamental concept of the invention for the component to be essentially comprised of two parts, namely on the one hand the winding element that holds all three windings and can, in a particularly advantageous embodiment, be completely composed of ferrite material, and on the other hand a coil plate made of electrically non-conducting, non-ferromagnetic material, e.g. polymeric material, on which the winding element is fastened in such a way that the guide elements that are located on the bottom side of the winding element engage into corresponding recesses in the coil plate. The ends of the first and the second winding are thereby wound around the guide elements on the bottom side of the winding element, and the ends of the third winding, which is not applied until after the winding element has been placed onto the coil plate, are wound around corners or projections of the coil plate. The inner edges of the recesses in the coil plate and the areas adjacent to them on the bottom of the coil plate can be provided with a metallic coating. Likewise, the corners or projections of the coil plate, around which the ends of the third winding are wound, and the areas adjacent to them on the bottom of the coil plate, can be provided with a metallic coating. In that way, connecting contacts, to which the ends of the windings can be connected by soldering, are formed on the bottom side of the coil plate, so that the coil plate can be placed directly onto and attached to a circuit board.

The inductive miniature component according to the invention can be manufactured quickly and with little effort on appropriately equipped automatic manufacturing machines, as described below with the aid of exemplary embodiments.

BRIEF DESCRIPTION OF THE DRAWINGS

In the following, embodiments for inductive miniature components according to the invention and techniques for their manufacturing are described in more detail in conjunction with the accompanying drawings, in which.

DESCRIPTION OF SPECIFIC EMBODIMENTS

Figure 1:
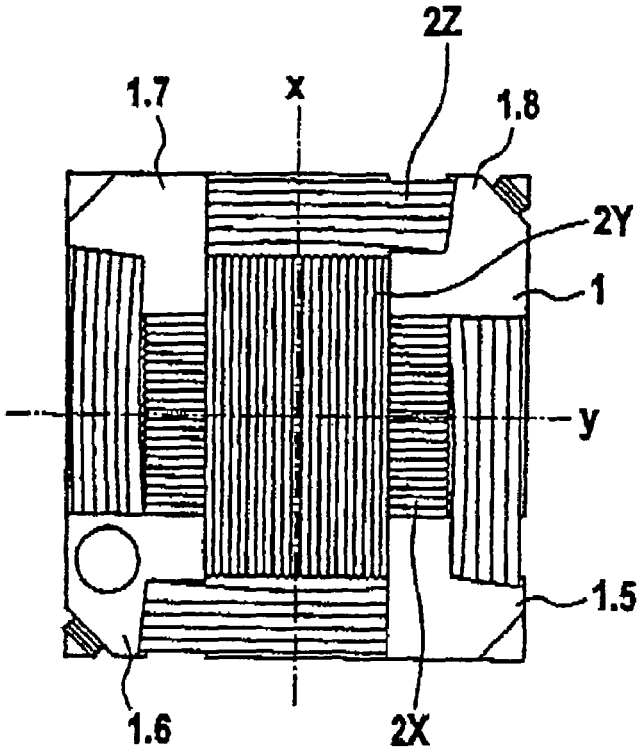
FIG. 1 shows an inductive miniature component, configured as a 3D-antenna, in a plan view.
Figure 2:
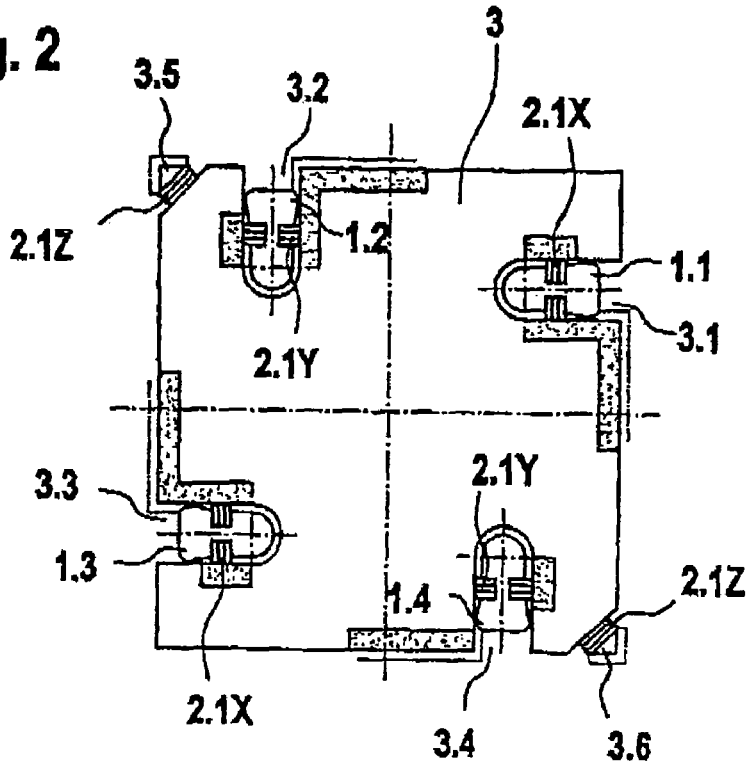
FIG. 2 shows the component according to FIG. 1 in a bottom view.
Figure 3:
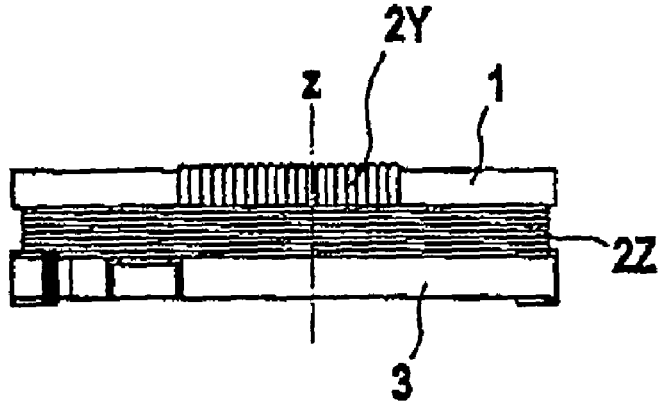
FIG. 3 shows the component according to FIG. 1 and 2 in a view of the narrow side.
Figure 4:
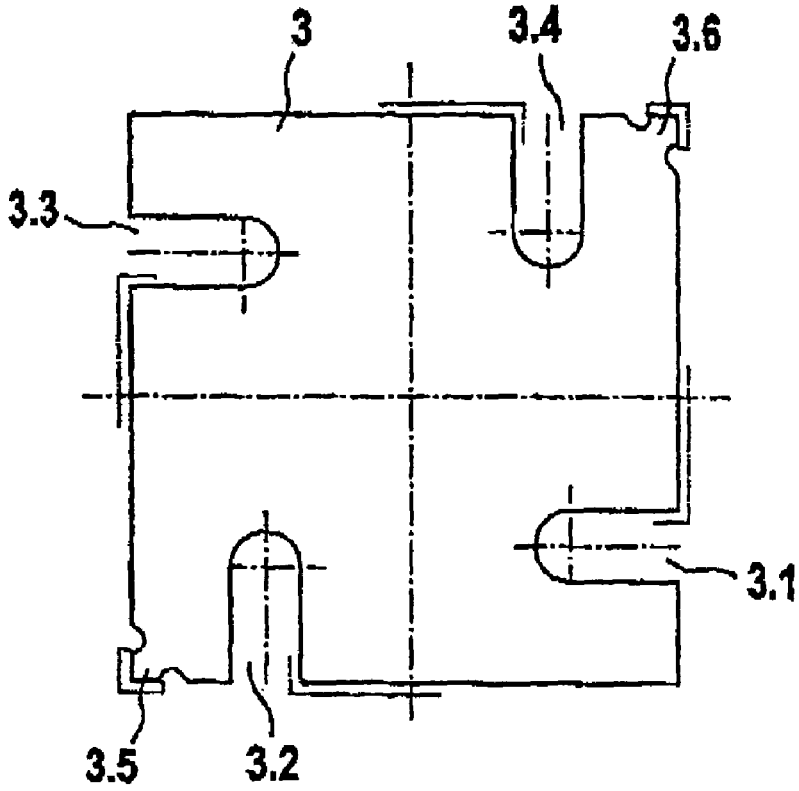
FIG. 4 shows the coil plate for the component according to FIGS. 1 through 3 in a plan view.

The inductive miniature component represented in FIGS. 1 through 8 comprises a winding element 1 that is configured as a flat and essentially rectangular part. The three windings 2X, 2Y and 2Z are disposed on the winding element 1 in such a way that their axes extend in the three spatial directions X, Y and Z that are located at right angles relative to each other and are indicated in FIGS. 1 and 3. The windings, as can be seen in FIGS. 1 and 3, are disposed on the winding element 1 in such a way that a first winding 2X and a second winding 2Y, occupying the length and width of the winding element 1, are wound around the winding element 1 in two directions that lie perpendicular to each other and parallel to the central plane of the winding element 1. A third winding 2Z is wound around the winding element 1 along its narrow side and following its periphery. On its bottom side, the winding element 1 has the guide elements 1.1 through 1.4, and on its top side the guide elements 1.5 though 1.8. In the embodiment represented in FIGS. 1 through 8, the winding element 1 and both the guide elements 1.1 through 1.4 on the bottom side of the winding element 1 and the guide elements 1.5 through 1.8 on the top side of the winding element 1 are composed of ferrite material. They are formed in one piece and made of the same material and are thus connected to each other. The winding element 1 is placed onto and connected to a coil plate 3, which is made of polymeric material. The coil plate 3 has recesses 3.1 through 3.4 that extend over the thickness of the coil plate 3 and are open towards its periphery. The inner contour and the arrangement of those recesses corresponds to the outer contour and to the arrangement of the guide elements 1.1 through 1.4 that are located on the bottom of the winding element 1. This configuration has the effect that the winding element 1 can be placed onto the coil plate 3 in such a way that the guide elements 1.1 through 1.4 engage into the recesses 3.1 through 3.4 in the coil plate 3. The ends 2.1X of the first winding 2X are wound around the guide elements 1.1 and 1.3, while the ends 2.1Y of the second winding 2Y are wound around the guide elements 1.2 and 1.4.

Figure 5:
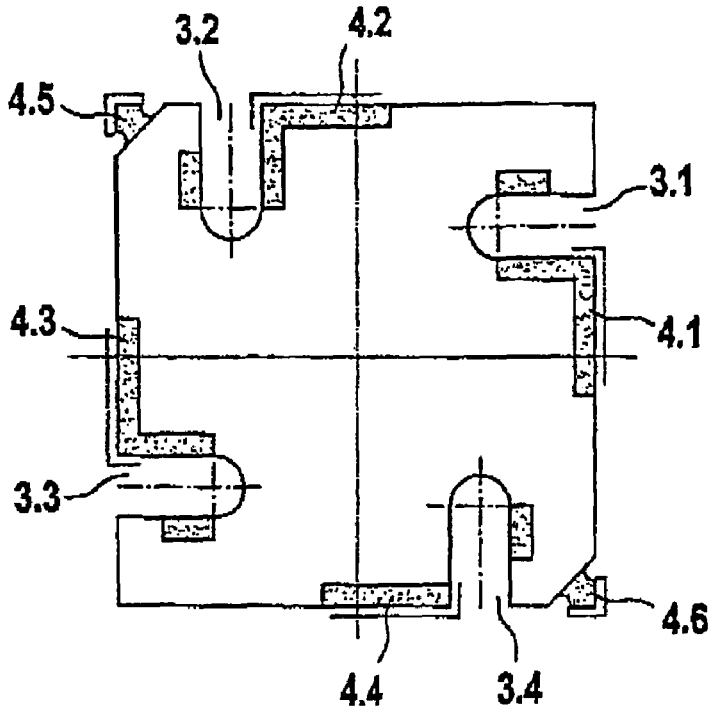
FIG. 5 shows the coil plate according to FIG. 4 in a bottom view.
Figure 6:
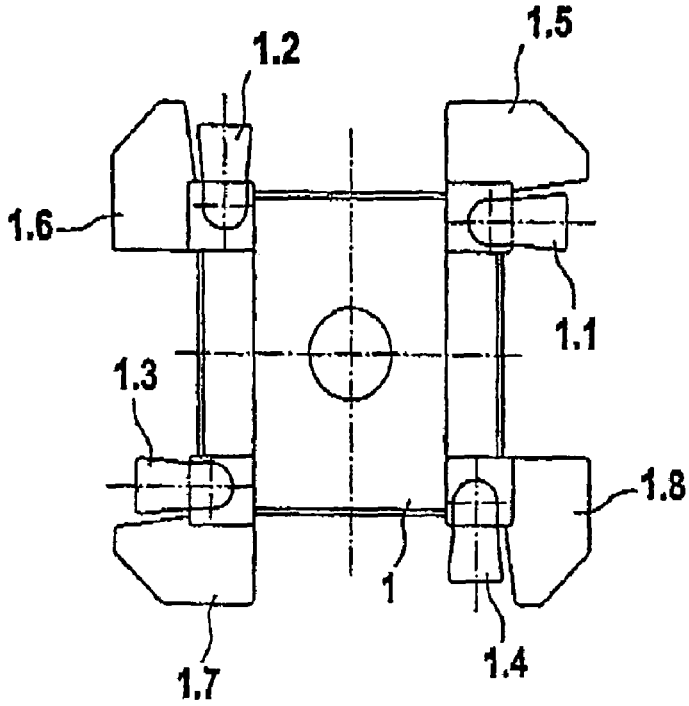
FIG. 6 shows the winding element of the component according to FIGS. 1 through 3 in a bottom view.

The thickness of the coil plate 3 is essentially equivalent to the thickness of the guide elements 1.1 through 1.4 on the bottom side of the winding element 1. The inner edges of the recesses 3.1 through 3.4 in the coil plate 3 and, as can be seen in FIG. 5, the adjacent areas of a defined width on the bottom of the coil plate 3, are provided with a metallic coating. The areas having the metallic coating on the bottom of the coil plate 3 are labeled 4.1 though 4.4.

The ends 2.1Z of the third winding 2Z are wound around the corner projections 3.5 and 3.6 of the coil plate 3. These corner projections 3.5 and 3.6 of the coil plate 3 and the adjacent areas 4.5 and 4.6 on the bottom are also provided with a metallic coating. This configuration has the effect that the areas 4.1 through 4.6 with metallic coating that are located on the bottom side of the coil plate 3 can each, by soldering, be connected electrically with one of the ends of the windings 2X, 2Y and 2Z and therefore provide the connecting contact for those windings. For the mounting, the component can hence, with its bottom side, be placed onto and be connected to a correspondingly equipped circuit board.

Figures 19A, 19B, 19C, 19D, 19E:
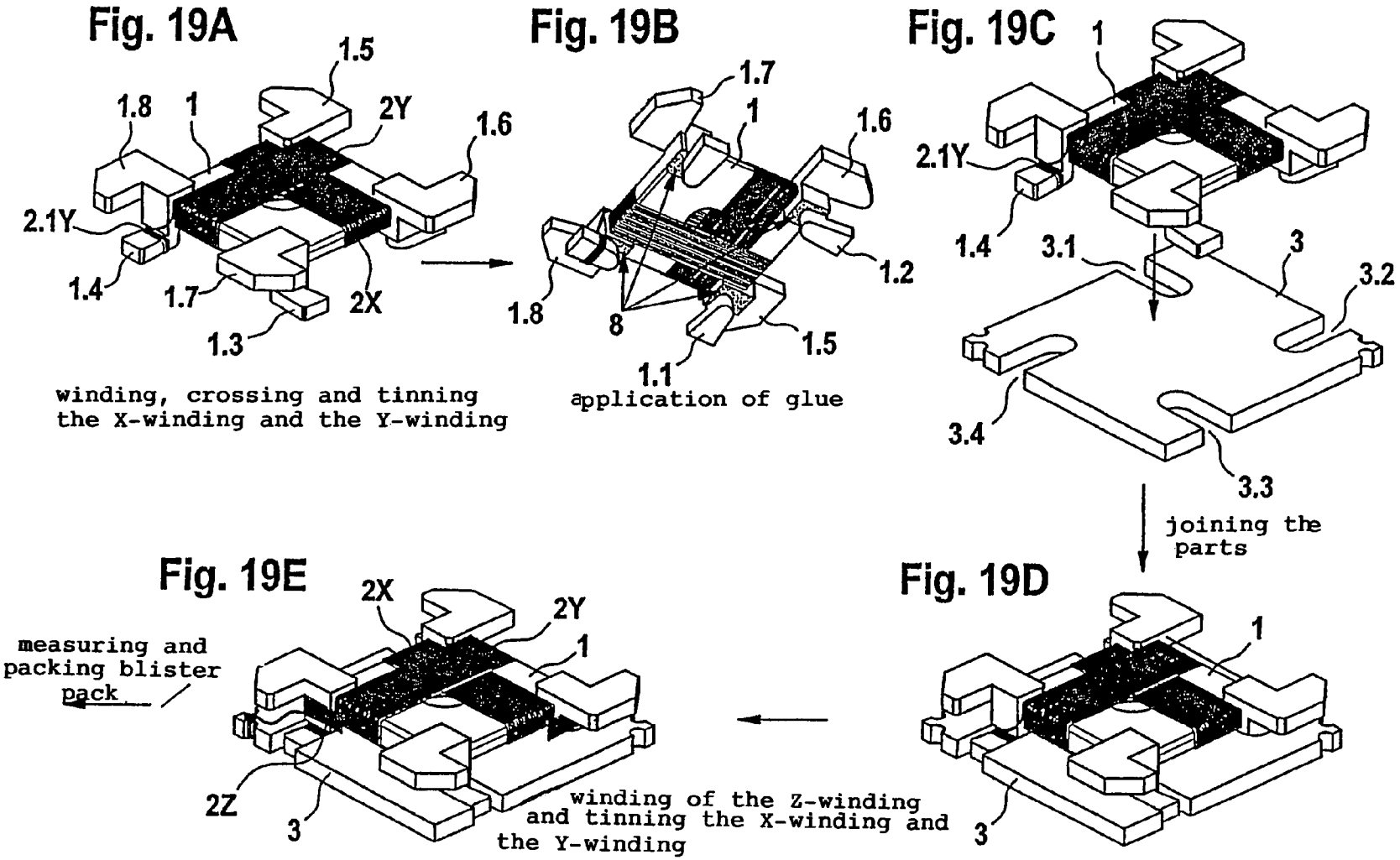
FIGS. 19A through 19E show the component according to FIGS. 1 through 8 in different phases of the manufacturing.

As can be seen in FIGS. 1 and 3 and in the sequence of FIGS. 19A though 19E, which are explained later on, the top of the third winding 2Z extends along the guide elements 1.5 through 1.8 and the bottom of the third winding 2Z extends both along the guide elements 1.1 through 1.4 and additionally along the upper surface of the coil plate 3, so that a secure seating of the third winding 2Z is ensured.

Figure 7:
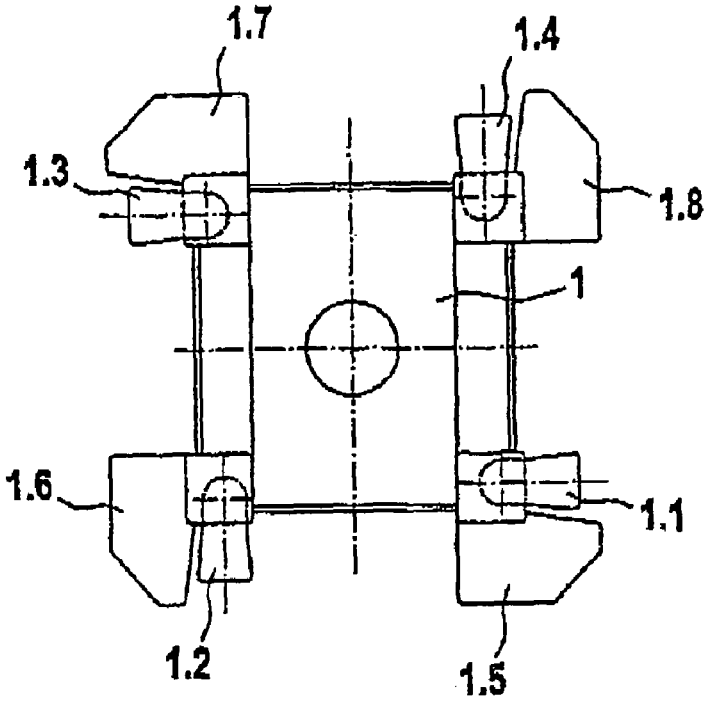
FIG. 7 shows the winding element according to FIG. 6 in a plan view.
Figure 8:
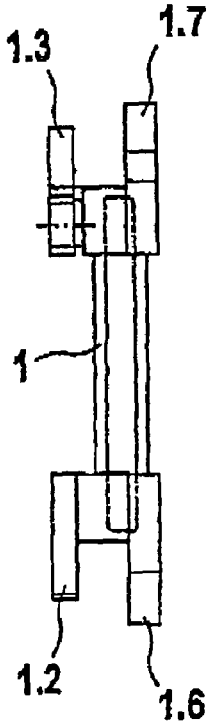
FIG. 8 shows the winding element according to FIGS. 6 and 7 in a view of the narrow side.
Figure 9:
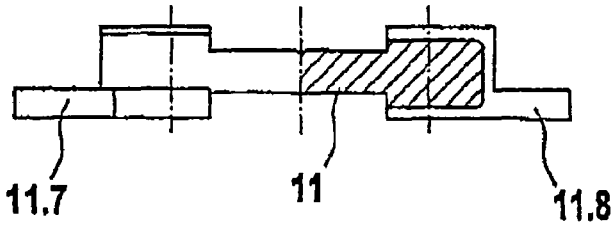
FIG. 9 shows a different embodiment of a winding element for a component as represented in FIGS. 1 through 3 in a side view, partially sectioned along the line IX-IX in FIG. 11.
Figure 10:
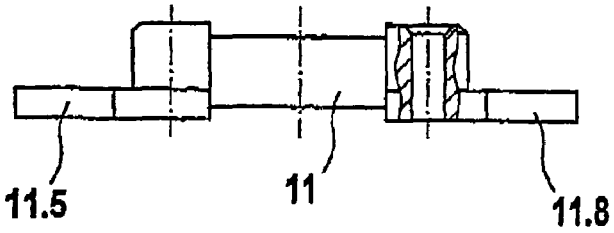
FIG. 10 shows the winding element represented in FIG. 9 in a side view, partially sectioned along the line X-X.
Figure 11:
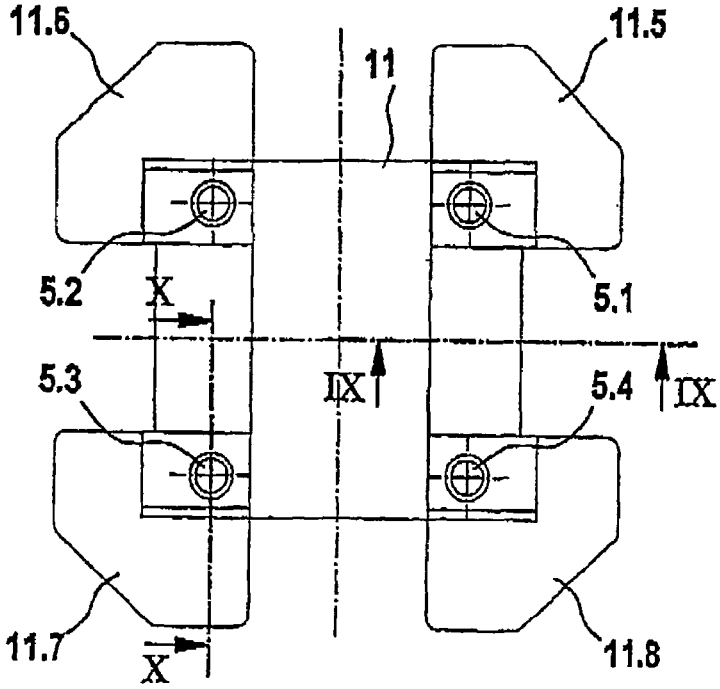
FIG. 11 shows the winding element according to FIGS. 9 and 10 in a bottom view.
Figure 12:
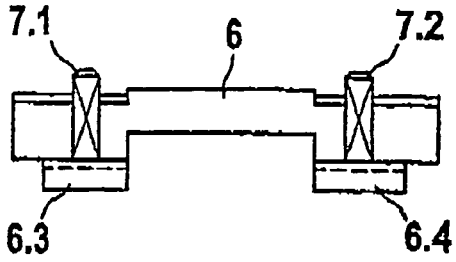
FIG. 12 shows, in a view of the wide side, a part of polymeric material that holds guide elements and is to be attached to the winding element according to FIGS. 9 through 11.
Figure 13:
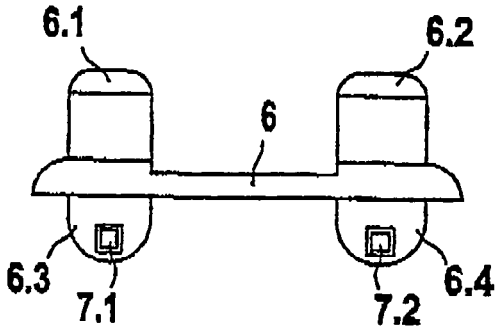
FIG. 13 shows the part of polymeric material according to FIG. 12 in a plan view.
Figure 14:
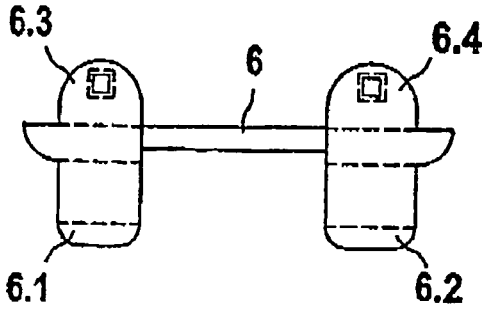
FIG. 14 shows the part of polymeric material according to FIGS. 12 and 13 in a bottom view.
Figure 15:
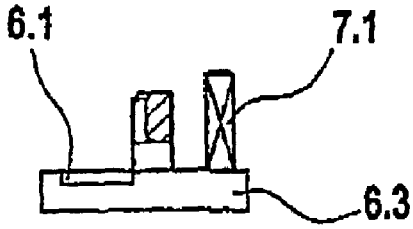
FIG. 15 shows the part of polymeric material according to FIGS. 12 through 14 in a view of the narrow side.
Figure 16:
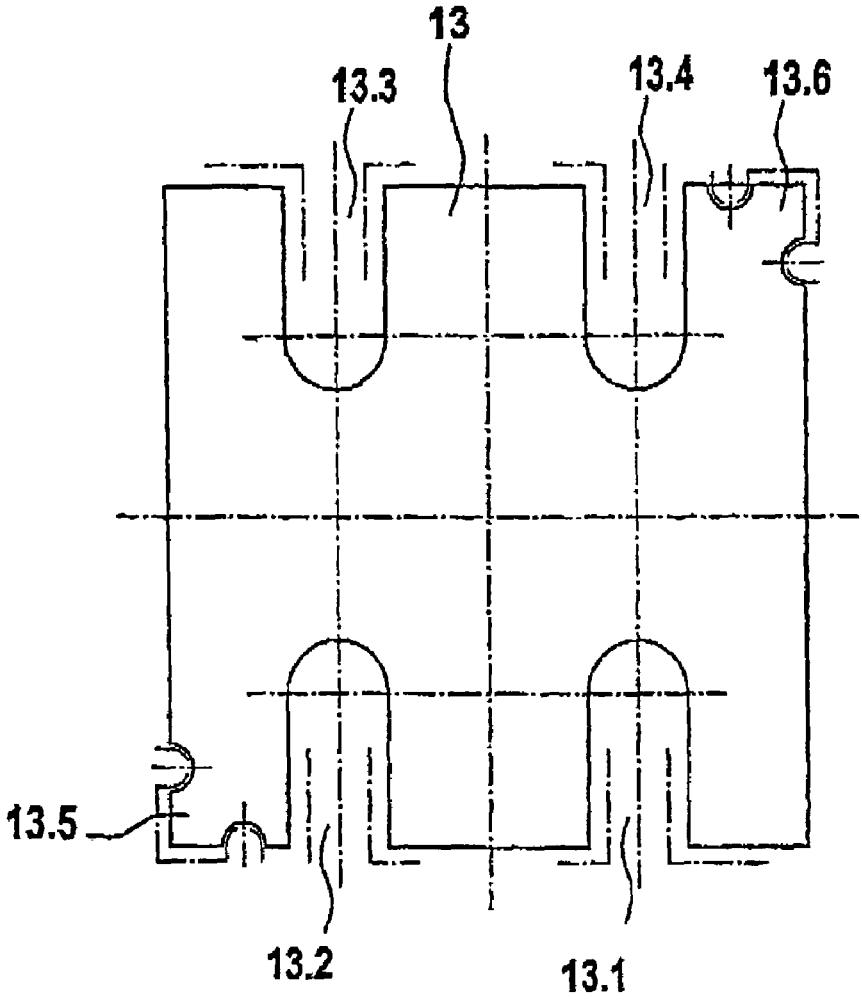
FIG. 16 shows a different embodiment of a coil plate in a plan view.
Figure 18:
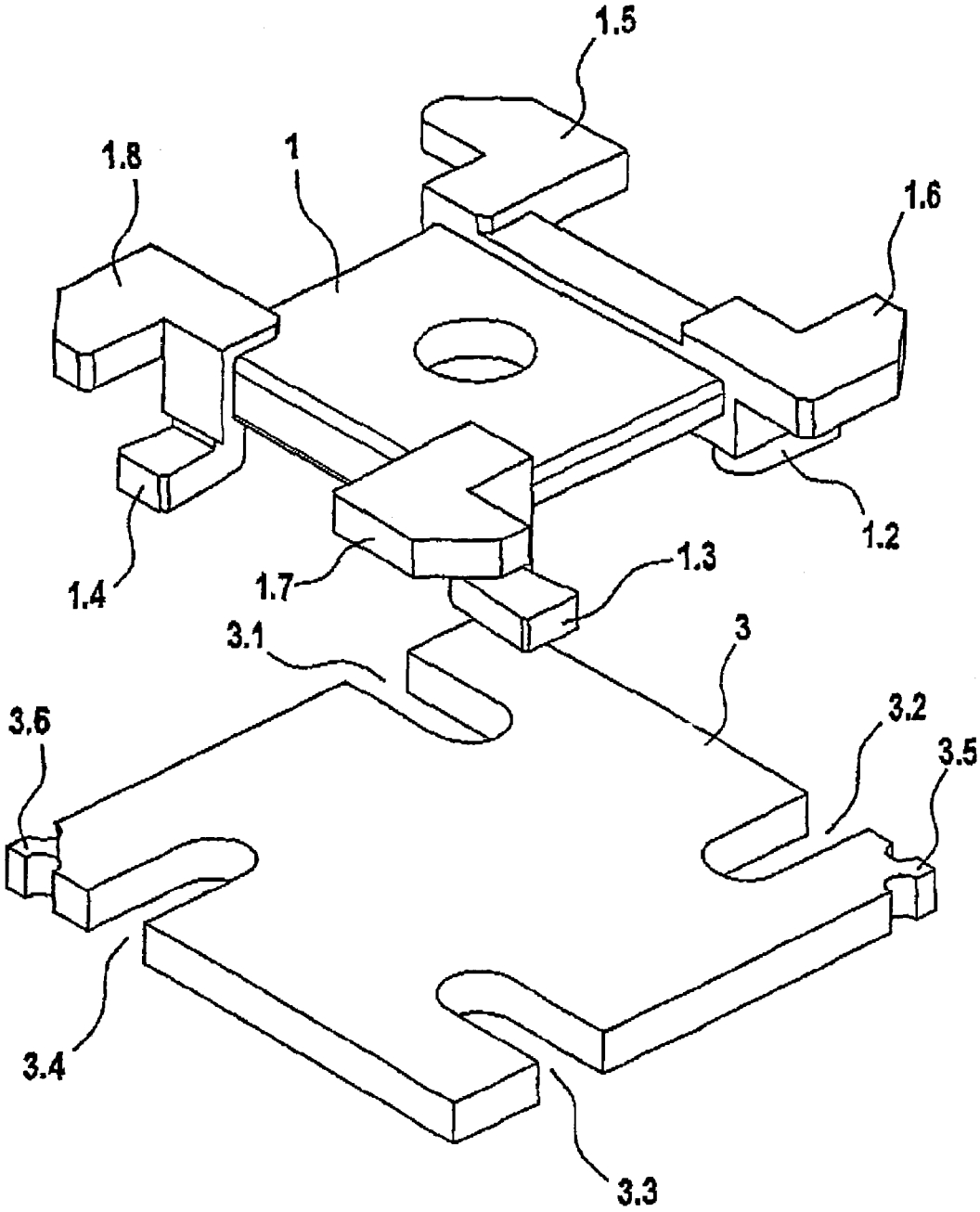
FIG. 18 shows the winding element and the coil plate according to FIGS. 4 through 8 without the windings in an exploded perspective representation.

In the embodiment represented in FIGS. 1 through 8 and in FIGS. 18 and 19, the guide elements are arranged on the winding element 1 in such a manner that they project outwardly. If viewed in a circumferential direction of the winding element 1, the guide elements on the top side of the winding element 1, e.g. the guide element 1.5 in FIG. 7, are essentially located in front of the pertaining corner of the winding element 1, whereas the associated guide elements on the bottom side of the winding element 1, e.g. the guide element 1.1, are located behind the pertaining corner. The guide elements 1.5 through 1.8 that are located on the top side of the winding element 1 each have a projection that extends, transverse to their longitudinal direction, over the adjacent corner, whereas the guide elements 1.1 through 1.4 that are located on the bottom of the winding element 1 are configured as hook-shaped feet that extend outwardly.

The abovementioned configurations that can also be seen well in FIG. 18 facilitate the manufacturing of the winding element 1 with the guide elements as one continuous die casting part, since undercuts are avoided in that manner.

The FIGS. 9 through 15 show a different embodiment of a winding element, in which the winding element 11 itself and the guide elements 11.5 through 11.8 that are located on its top side are composed of ferrite material and formed in one piece, yet the guide elements on the bottom side of the winding element 11 are not formed in one piece with the winding element 11. On the contrary, they are formed of polymeric material and placed onto the bottom side of the winding element 11 and attached to it fixedly.

For that reason, the guide elements 6.1 and 6.2 are integrated, in pairs, into a part 6 of polymeric material. The part 6 of polymeric material has projections 6.3 and 6.4, which extend, in the mounted state, towards the inside of the winding element 11 and are provided with pins 7.1 and 7.2. The pins 7.1 and 7.2 can be introduced into corresponding holes 5.1 through 5.4 on the bottom side of the winding element 11. Gluing ensures a fixed connection. Two of the parts 6 of polymeric material that are represented in FIGS. 12 through 15 are required for each winding element 11 so that after the parts 6 of polymeric material are applied and attached, a total of four of the guide elements 6.1 and 6.2 are located on the bottom side. Those guide elements can then be introduced into a coil plate 13 that is represented in FIGS.

Figure 17:
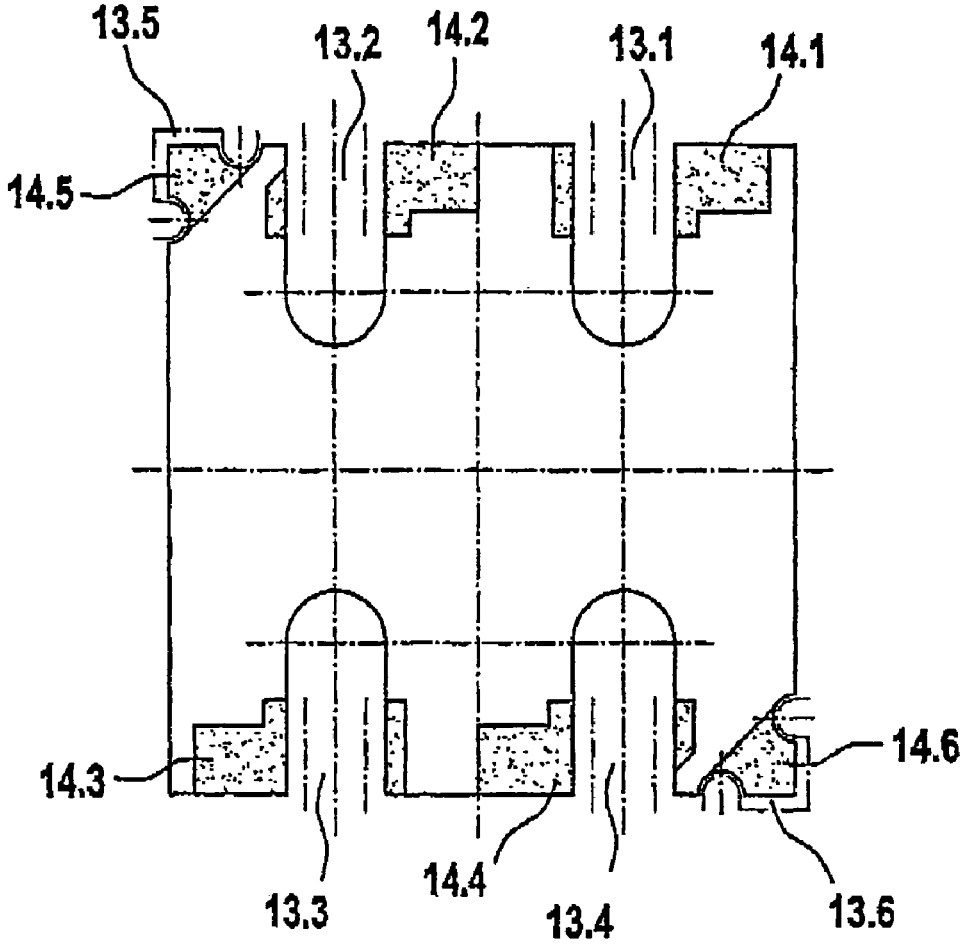
FIG. 17 shows the coil plate according to FIG. 16 in a bottom view.

16 and 17. Corresponding to the arrangement of the guide elements on the bottom side of the winding element 11, which, in pairs, project outwardly on two opposite sides of the winding element 11, the recesses 13.1 through 13.4 in the coil plate 13 are likewise arranged on two opposite sides and open outwardly. The inner edges of the recesses 13.1 through 13.4 in the coil plate 13 are provided with a metallic coating. Likewise, on the bottom of the coil plate 13, the areas 14.1 through 14.4 that are located adjacent to the recesses 13.1 through 13.4 are provided with such a metallic coating, as can be seen in FIG. 17. Moreover, in the bottom area, the corner projections 13.5 and 13.6 are provided with the areas 14.5 and 14.6 of metallic coating.

During manufacturing of an inductive miniature component with the parts represented in FIGS. 9 through 17, the winding element 11 is provided with three windings in an equivalent manner as it was explained in conjunction with FIGS. 1 through 3.

The ends of the first and second winding are again wound around the guide elements on the bottom of the winding element 11, whereas the ends of the third winding are wound around the corner projections 13.5 and 13.6. In the same manner as described above, those ends of the windings are then brought into electrical contact with the metallic areas 14.1 through 14.6 on the bottom of the coil plate 13. Thus, the connecting contacts for the component are formed.

Described below are the procedures that are used to manufacture the inductive miniature component—on the one hand according to FIGS. 1 through 8 and on the other hand according to FIGS. 9 through 17—on an appropriately equipped automatic manufacturing machine.

During the manufacturing of a part according to FIGS. 1 through 8, the following operational steps take place automatically:

a) Providing a winding element composed of ferrite material with guide elements arranged on the top and on the bottom side that are formed in one piece with the winding element;

b) Winding a first and a second winding onto the winding element in two directions that lie perpendicular to each other and parallel to the central plane of the winding element;

c) Winding the ends of the applied windings around the guide elements on the bottom side of the winding element;

d) Application of a glue onto defined areas on the bottom side of the winding element;

e) Providing a coil plate with recesses associated to the guide elements that are on the bottom side of the winding element;

f) Joining the winding element and the coil plate;

g) Winding a third winding along the narrow side of the winding element into the space between the guide elements on the top side of the winding element and the guide elements on the bottom side of the winding element or the surface of the coil plate;

h) Winding the ends of the third winding around corners or projections of the coil plate and tinning those ends of the winding;

i) Connecting the ends of the windings with metallic coatings of the coil plate by soldering;

j) Removal of the component for measuring and packing.

This sequence of operations is represented schematically in FIGS. 19A through 19E.

For the manufacturing of an inductive miniature component according to FIGS. 9 through 17, a procedure can be used during which the following operational steps take place in a fully automatic manner:

a) Providing a winding element composed of ferrite material with guide elements arranged on the top side that are formed in one piece with the winding element;

b) Application of a glue onto defined areas on the bottom side of the winding element;

c) Providing guide elements composed of polymeric material and attachment of those guide elements on the bottom side of the winding element;

d) Winding a first and a second winding onto the winding element in two directions that lie perpendicular to each other and parallel to the central plane of the winding element;

e) Winding the ends of the applied windings around the guide elements on the bottom side of the winding element;

f) Application of a glue onto defined areas on the bottom side of the winding element;

g) Providing a coil plate with recesses associated to the guide elements on the bottom side of the winding element;

h) Joining the winding element and the coil plate;

i) Winding a third winding along the narrow side of the winding element into the space between the guide elements on the top side and the guide elements on the bottom side or the surface of the coil plate;

j) Winding the ends of the third winding around corners or projections of the coil plate;

k) Connecting the ends of the windings with metallic coatings on the coil plate by soldering;

l) Removal of the component for measuring and packing.

The specification incorporates by reference the disclosure of German priority document 103 51 119.9 filed Nov. 3, 2003 and PCT/DE2004/002205 filed Oct. 2, 2004.

The present invention is, of course, in no way restricted to the specific disclosure of the specification and drawings, but also encompasses any modifications within the scope of the appended claims.

The invention claimed is:

1. An inductive miniature component, comprising:

a winding element of ferrite material embodied as an essentially flat, multi-sided part, wherein three windings are disposed on said winding element such that axes of said windings extend in three spatial directions that are respectively perpendicular to one another, wherein a first winding and a second winding are wound around said winding element, over a length and width thereof, in two directions that are perpendicular to one another in a central plane of said winding element, wherein a third winding is wound around a narrow side of said winding element following the periphery of said winding element;

first guide elements disposed on an underside of said winding element for guiding one side of said third winding, wherein ends of said first and second windings are wound around respective ones of said first guide elements;

second guide elements disposed on an upper side of said winding element for guiding another side of said third winding, wherein said second guide elements are made of ferrite material and are monolithic with said winding elements;

a coil plate of electrically non-conducting, non-ferromagnetic material, wherein said winding element and said coil plate are placed together and interconnected, wherein said coil plate is provided with recesses that extend over a thickness of said coil plate, wherein said recesses have an inner contour and arrangement that corresponds to an outer contour and arrangement of said first guide elements, and wherein said winding element and said coil plate are placed together such that said first guide elements engage into said recesses; and corners or projections provided on said coil plate, wherein ends of said third winding are respectively wound around said corners or projections.

2. A miniature component according to claim 1, wherein said guide elements are made of ferrite material and are monolithic with said winding element.

3. A miniature component according to claim 1, wherein said first guide elements are made of polymeric material.

4. A miniature component according to claim 3, wherein said first guide elements are integrated individually or in pairs into a part of polymeric material, and wherein said part is provided with at least one upwardly extending pin that is adapted to be inserted into an associated whole on the underside of said winding element.

5. A miniature component according to claim 1, wherein said first and second guide elements project outwardly from the periphery of said winding element and are disposed in such a way that when viewed in a circumferential direction, each of said second guide elements is essentially disposed in front of a corner of said winding element, while the associated first guide element is disposed behind such corner.

6. A miniature component according to claim 1, wherein said first and second guide elements project outwardly from the periphery of said winding element, and wherein said first guide elements are disposed in pairs on two opposite sides of said winding element.

7. A miniature component according to claim 1, wherein the thickness of said coil plate corresponds to a thickness of said first guide elements.

8. A miniature component according to claim 1, wherein said recesses of said coil plate open toward a periphery of said coil plate.

9. A miniature component according to claim 1, wherein inner edges of said recesses of said coil plate, and adjoining portions of a prescribed width on a base and/or on a narrow side of said coil plate, are provided with a metallic coating.

10. A miniature component according to claim 1, wherein said corners or projections of said coil plate are provided on narrow sides and/or on adjoining bottom areas of a prescribed width with a metallic coating.

11. A miniature component according to claim 1, wherein said first guide elements are embodied as hook-shaped feet that extend outwardly.

12. A miniature component according to claim 5, wherein said second guide elements each have a projection that extends outwardly transverse to its length and over an adjacent corner.

13. A method of producing an inductive miniature component, including the steps of:

providing a winding element of ferrite material, wherein first elements of ferrite material are monolithically disposed on an underside of said winding plate, and wherein second guide elements of ferrite material are monolithically disposed on an upper side of said winding element;

winding a first and second winding on said winding element in two directions that are disposed perpendicular to one another and in a central plane of said winding element;

winding ends of said first and second windings around said first guide elements;

applying an adhesive to prescribed areas on the underside of said winding element;

providing a coil plate having recesses that are associated with said first guide elements, wherein inner edges of said recesses, and adjoining areas of defined width on a base and/or narrow side of said coil plate, are provided with a metallic coating;

joining said winding element and said coil plate together;

winding a third winding along a narrow side of said winding element in a space between said second guide elements and said first guide elements and/or a surface of said coil plate;

winding ends of said third winding around corners or projections of said coil plate, wherein narrow sides and/or adjoining areas of defined width on a bottom of said corners or projections are provided with a metallic coating;

connecting said ends of said windings with respective ones of said metallic coatings of said coil plate by soldering; and removing said component for measurement and packaging.

14. A method of producing an inductive miniature component, including the steps of:

providing a winding element of ferrite material, wherein first guide elements of ferrite material are monolithically disposed on an upper side of said winding element;

providing second guide elements of polymeric material and securing said second guide elements to an underside of said winding element;

winding a first and a second winding on said winding element in two directions that are disposed perpendicular to one another and in a central plane of said winding element;

winding ends of said first and second windings around said second guide elements;

applying an adhesive to prescribed areas on the underside of said winding element;

providing a coil plate having recesses that are associated with said second guide elements, wherein inner edges of said recesses, and adjoining areas of defined width on a base and/or narrow side of said coil plate, are provided with a metallic coating;

joining said winding element and said coil plate together;

winding a third winding along a narrow side of said winding element in a space between said first guide elements and said second guide elements and/or a surface of said coil plate;

winding ends of said third winding around corners or projections of said coil plate, wherein narrow sides and/or adjoining areas of defined width on a bottom of said corners or projections are provided with a metallic coating;

connecting said ends of said windings with respective ones of said metallic coatings of said coil plate by soldering; and removing said component for measuring and packaging.

* * * * *